US006619488B2

(12) United States Patent
Bengoechea

(10) Patent No.: US 6,619,488 B2
(45) Date of Patent: Sep. 16, 2003

(54) CORNER SHELF AND FIXING SYSTEM

(75) Inventor: Alberto Bengoechea, Santiago (CL)

(73) Assignee: Inber SA, Santiago (CL)

( * ) Notice: Subject to any disclaimer, the term of this patent is extended or adjusted under 35 U.S.C. 154(b) by 0 days.

(21) Appl. No.: 09/925,197

(22) Filed: Aug. 9, 2001

(65) Prior Publication Data

US 2002/0017499 A1 Feb. 14, 2002

(30) Foreign Application Priority Data

Aug. 9, 2000 (CL) ..... 2123-2000

(51) Int. Cl.[7] ..... A47F 5/08
(52) U.S. Cl. ..... 211/90.01; 108/42; 108/152
(58) Field of Search ..... 211/90.01, 90.02; D6/553, 562; 108/42, 152, 157.13, 147.11

(56) References Cited

U.S. PATENT DOCUMENTS 4,708,310 A * 11/1987 Smith ..... 211/90.01
6,164,610 A * 12/2000 Santiago ..... 211/90.01
6,196,139 B1 * 3/2001 Jensen et al. ..... 108/42

FOREIGN PATENT DOCUMENTS

GB 2214782 A * 9/1989 ..... A47B/96/00
JP 10313962 A * 12/1998 ..... A47B/96/02
WO 93/02594 2/1993

* cited by examiner

*Primary Examiner*—Daniel P. Stodola
*Assistant Examiner*—Erica B. Harris
(74) *Attorney, Agent, or Firm*—D. Peter Hochberg; Katherine R. Vieyra; Sean Mellino

(57) ABSTRACT

A corner shelf and the system to fix the shelf between corner walls, said system created with the minimum of elements, and hiding these elements with the lateral borders of the shelf. The corner shelf comprises an upper surface, a lower surface, a first lateral face and a second lateral face where said first lateral face possesses a perforation parallel to the upper and lower surfaces; said second lateral face possesses a groove parallel to the surface, and terminating in a perforation being perpendicular to the lower surface. The system of fixation comprises a first fixation element introduced in a perforation located in said first lateral face; and a second fixation element whose horizontal body is introduced in a groove located in said second lateral face, the head of said second fixation element introduced in the perforation which terminates in the groove.

13 Claims, 6 Drawing Sheets

Figure 7
Figure 6
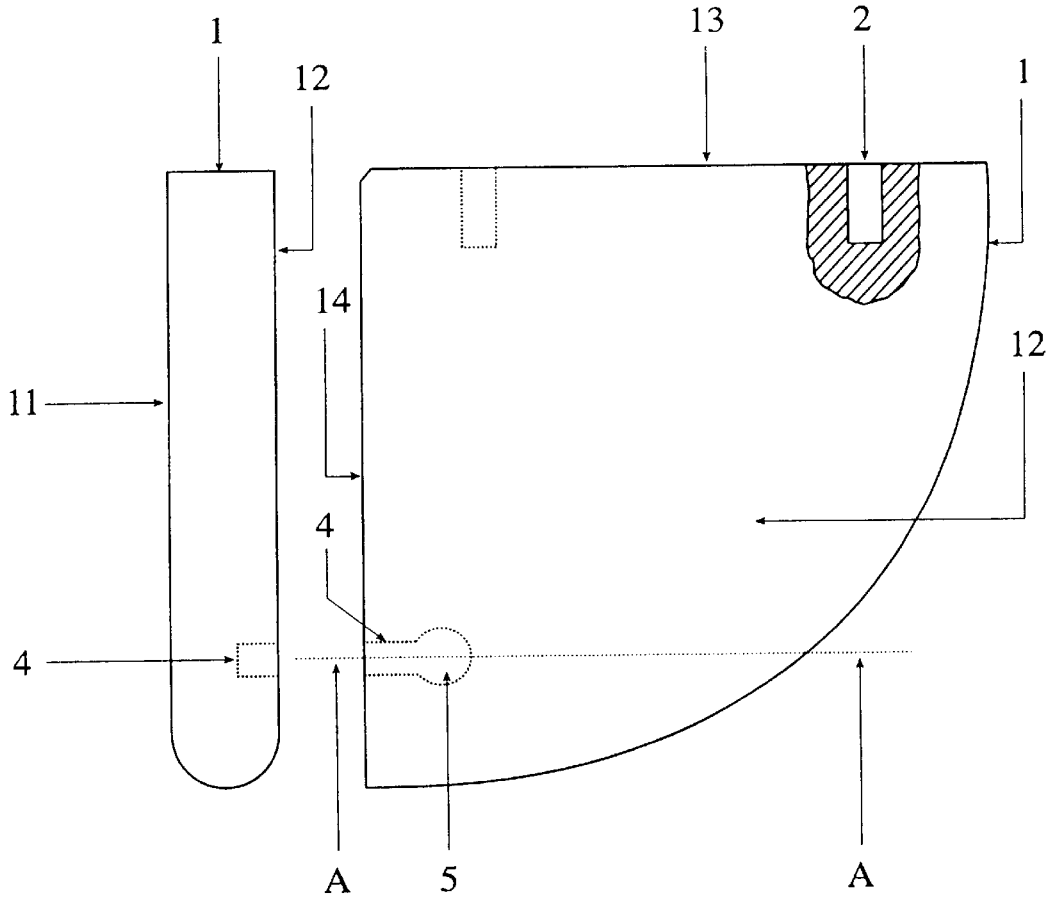
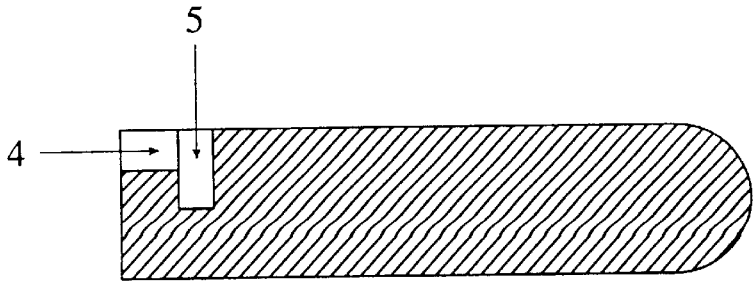
Corte A-A
Figure 8

CORNER SHELF AND FIXING SYSTEM

FIELD OF APPLICATION

The present invention relates to a corner shelf and the system to install and fix the shelf between walls that are intercepted to form a corner. Basically, the present invention is oriented to the corner shelf manufactured preferably in wood or the like, whose fixation system to the walls of a room requires a minimum of elements or accessories, which are covered or hidden by the external faces of the shelf, making that fixation less expensive and providing an aesthetic advantage that overcomes the corner shelves of the prior art.

DESCRIPTION OF THE PRIOR ART

There are a great quantity of corner shelves existing on the market which are basically consist of a cover or a shelf fixed to the walls through supports or squads, and said squads are visible, decreasing the aesthetic quality of the shelf. In the same way, the use of squads represents the use of a great number of accessories, which increases the price of the installation system.

Also in the state of the art are corner shelves in whose cover and near the borders that connect with the walls, there exist at least a couple of perforations which do not extend through the cover and are perpendicular to it, in such a way that each one of these perforations houses wooden plugs that are fixed to the walls. Although it is true that the use of accessories is minimized for the corner shelf fixation to the walls, the part of the wooden plug that does not enter into the perforation remains visible, which diminishes the aesthetic quality of the set.

The document EP 0597930, equivalent to the document WO 93/02594, of Brian Parry Slade, whose title is "Corner Support Apparatus" discloses a support apparatus to be fixed to the first and second walls of a corner of a room, formed between the first and second walls, which support apparatus comprises a first support member having at least a pair of spikes to be driven into the first wall, a second support member having at least a pair of spikes which are for being driven into the second wall and a corner shelf that has a first groove to receive the first support member and a second groove to receive the second support member, in such a way that the first and the second support members hold the corner shelf in its corresponding position. Although it is true that in this case, the necessary accessories for the fixation of the corner shelf are hidden by the extreme faces of the shelf that connect with the walls of the room, the quantity of necessary accessories for the fixation is quite considerable, increasing therefore the costs of manufacture of the product.

BRIEF DESCRIPTION OF THE INVENTION

The present invention is related to a corner shelf preferably in wood or the like, whose external faces present horizontal perforations and vertical perforations with external grooves, which house pins, screws, wooden plugs or the like, whose main objective is to hide the fixation system, and at the same time, to minimize the fixation accessories, in such a way as to lower the production costs.

The special characteristics of this invention will be disclosed next according to the following drawings.

DESCRIPTION OF THE DRAWINGS

FIG. 6 shows a bottom view of the corner shelf of the present invention.

FIG. 7 shows a view of a second face of wall connection of the corner shelf of the present invention.

FIG. 8 shows a cross-sectional view through the lines A-A indicated in FIG. 6.

DESCRIPTION OF THE INVENTION

Figure 1:
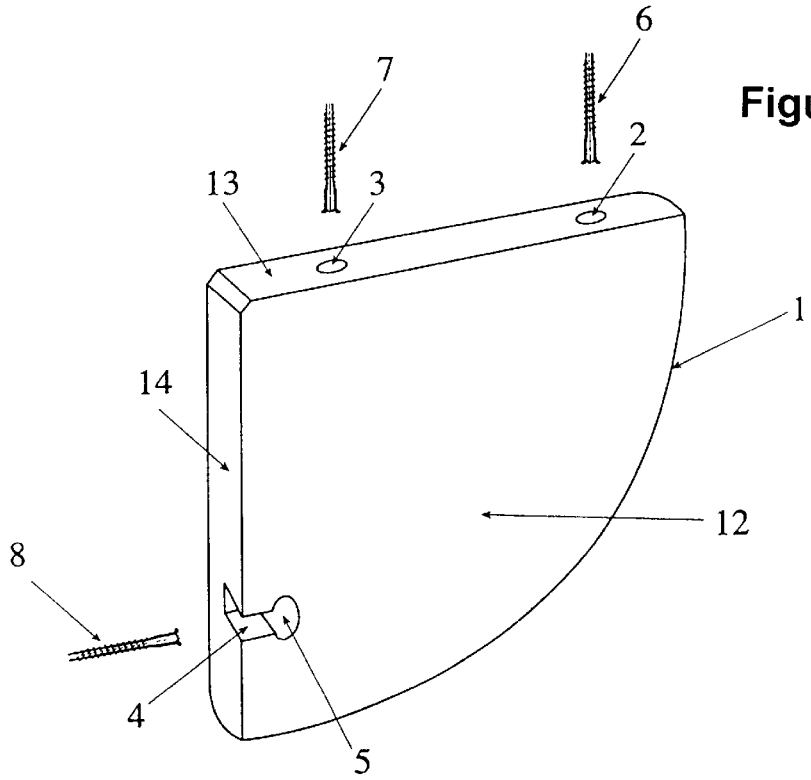
FIG. 1 shows a view in perspective from a lower angle of the corner shelf of the present invention.
Figure 2:
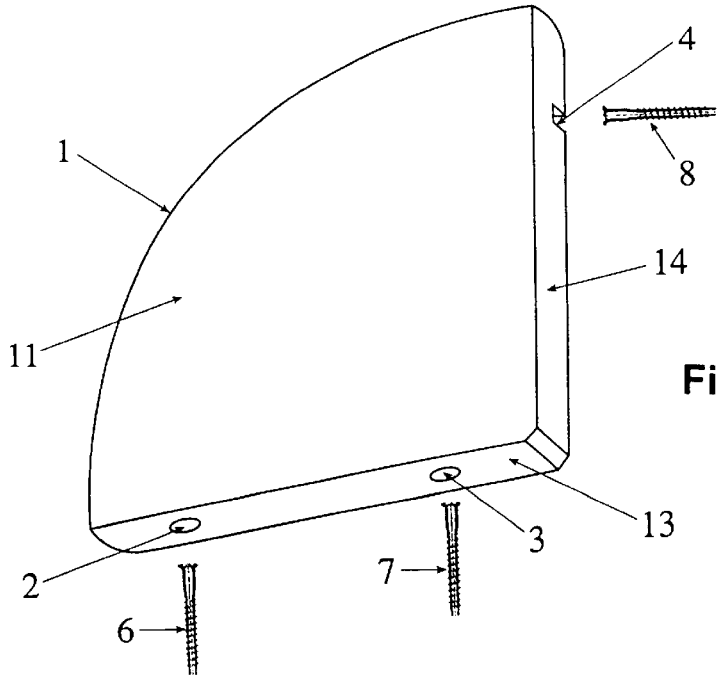
FIG. 2 shows a view in perspective, from an upper angle of the corner shelf of the present invention.
Figure 3:
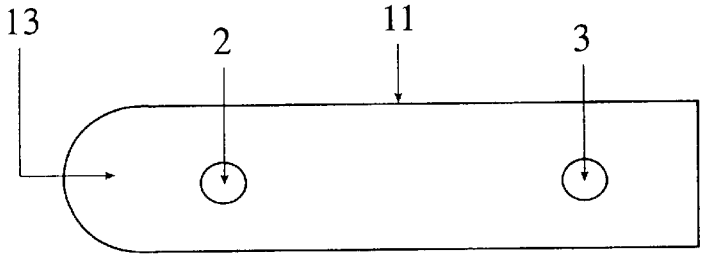
FIG. 3 shows a side view of the corner shelf of the present invention.
Figure 4:
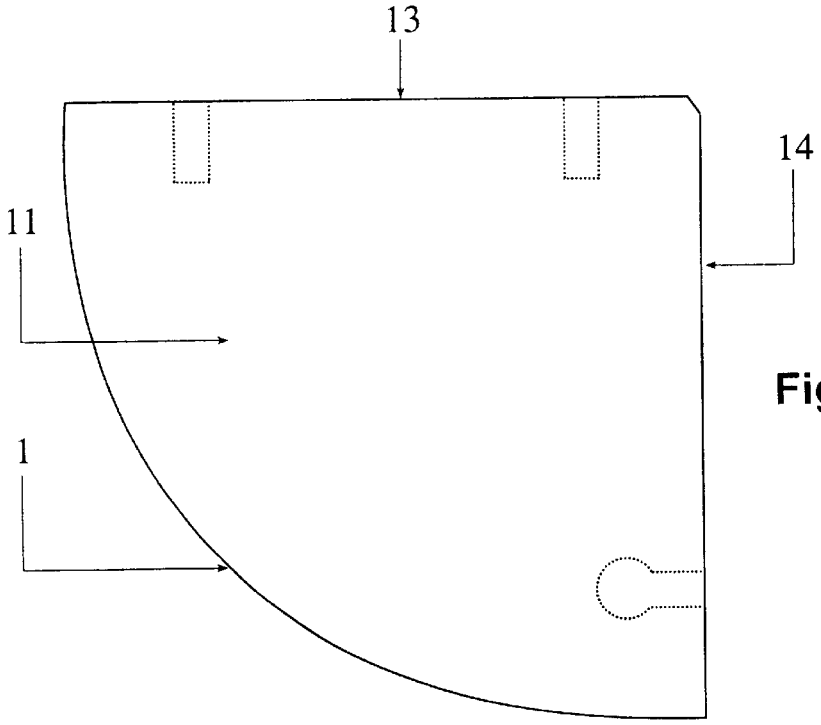
FIG. 4 shows a top view of a first face of wall connection of the corner shelf of the present invention.
Figure 5:
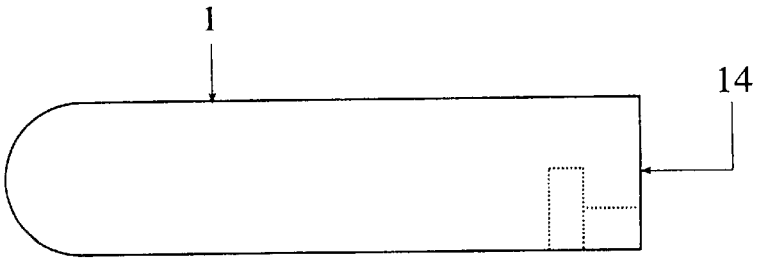
FIG. 5 shows a front view of the corner shelf of the present invention.
Figure 9:
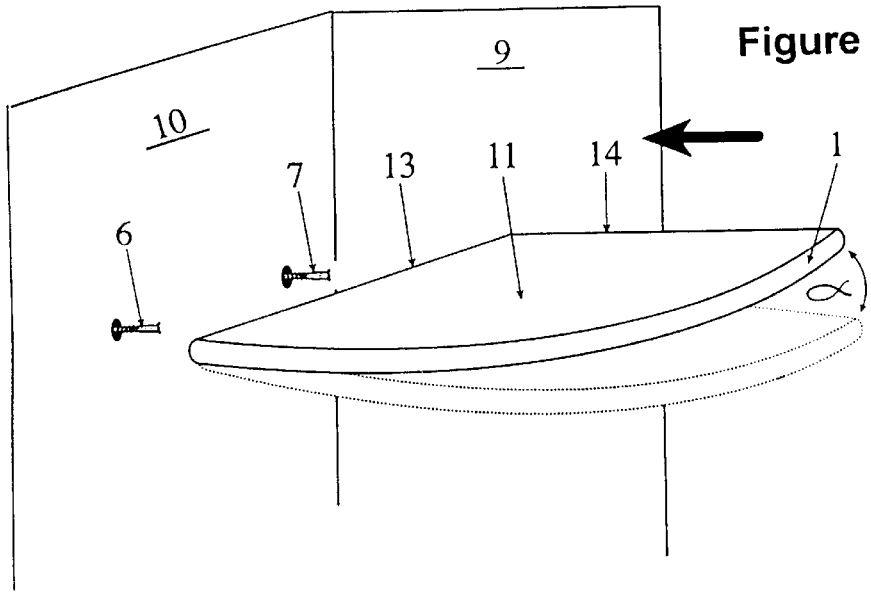
FIGS. 9 and 10 show mounting the corner shelf after the fixation accessories have been placed in the walls.
Figure 10:
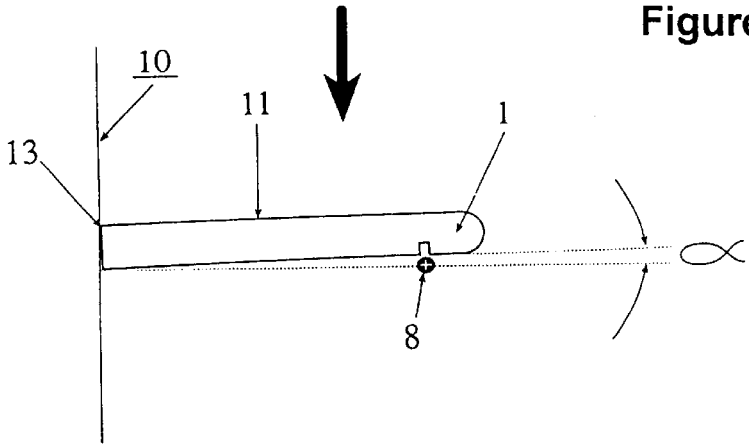
Figure 11:
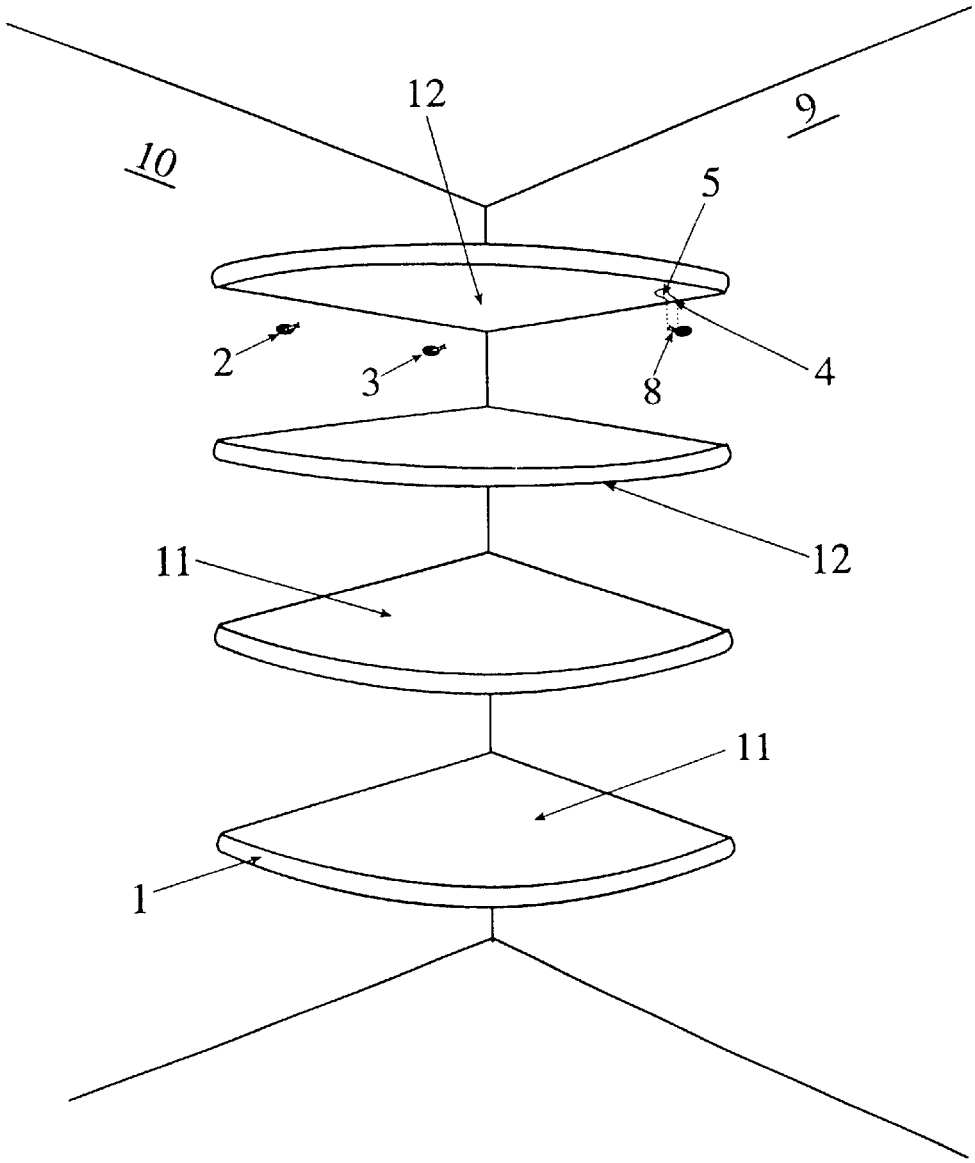
FIG. 11 shows a perspective view of a group of corner shelves fixed to the walls of a room.

By reference to the figures, the present invention refers to a corner shelf (1) and to its fixation system to get installed between a first wall (10) and a second wall (9) both being intercepted to form a corner. Basically, the present invention comprises a corner shelf (1) manufactured preferably in wood or the like whose fixation system to the walls of a room requires a minimum of elements or accessories, which are covered or hidden by the lateral faces (13, 14) of the shelf, so that a less expensive fixation and an aesthetic advantage which overcomes the corner shelves of the previous art is obtained.

The shelf (1) consists of a plain upper surface (11) and a plain lower surface (12). In a first lateral face (13), at least one closed hole or perforation (2, 3) parallel to the upper and lower surfaces (11, 12) exists on which is fitted at least one first fixation element (6, 7) which can be a nail, screw, pin or the like. In a second lateral face (14) there exists at least a groove (4) parallel to the surface (12) that hides the horizontal body of a second fixation element (8) which can be a nail, screw, wooden plug or the like. In the event that the second fixation element (8) has a head, this is hidden in the transverse closed hole or perforation (5) which does not extend through the surface and is perpendicular to the lower surface (12).

Such first fixation element (6, 7) is placed in a first wall (10) of a room, leaving part of its body to be introduced in at least one closed hole or perforation (2, 3). Such second fixation element (8) is placed in the second wall (9) of a room, leaving part of its body to be introduced in the groove (4) of the lower surface (12) of the corner shelf (1). At the end of the body of the second fixation element (8) a head can exist that is introduced in the transverse closed hole or perforation (5) which does not extend through the surface, perpendicular to the lower surface (12).

The maneuver of installation of the corner shelf (1) consists basically in putting this shelf in a horizontal and parallel way at the level of the first fixation element(s) (6, 7) already placed in a first wall (10) in a room. Before introducing such first fixation element(s) (6, 7) in the perforation(s) (2, 3), the corner shelf (1) should be lifted slightly in an angle $\alpha$ with the aim of not clogging said introduction for the head of the second fixation element (8), which has already been placed previously in the second wall (9) of the room. Once such first fixation element(s) (6, 7) has been introduced in at least one perforation (2, 3), the corner shelf (1) can be lowered, diminishing this angle a and introducing the head of the second fixation element (8) in the perforation (5) which does not extend through the surface, perpendicular to the lower surface (12).

Figure 12:
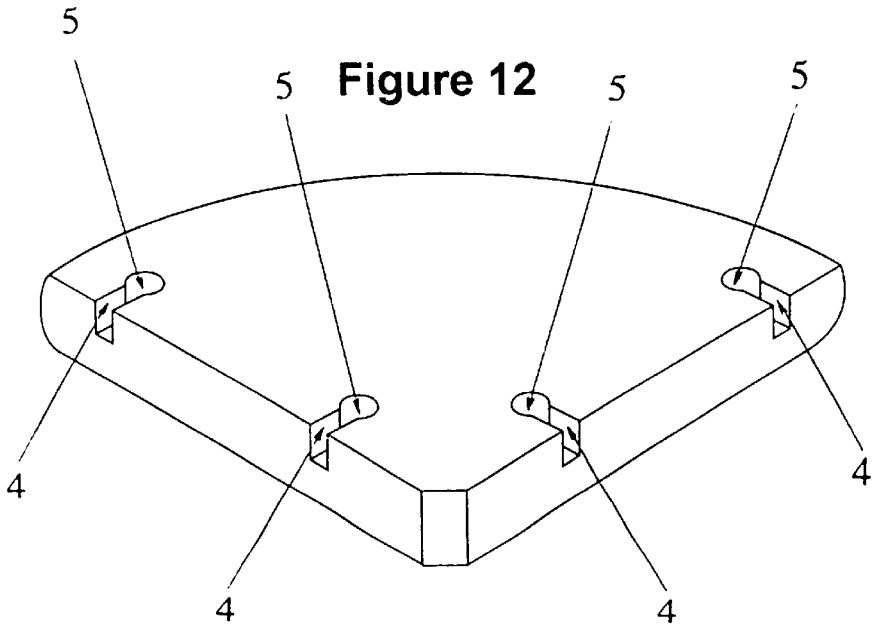
FIGS. 12 and 13 show a perspective view from a lower angle of the corner shelf that represent two alternatives of possible realizations of the present invention.
Figure 13:
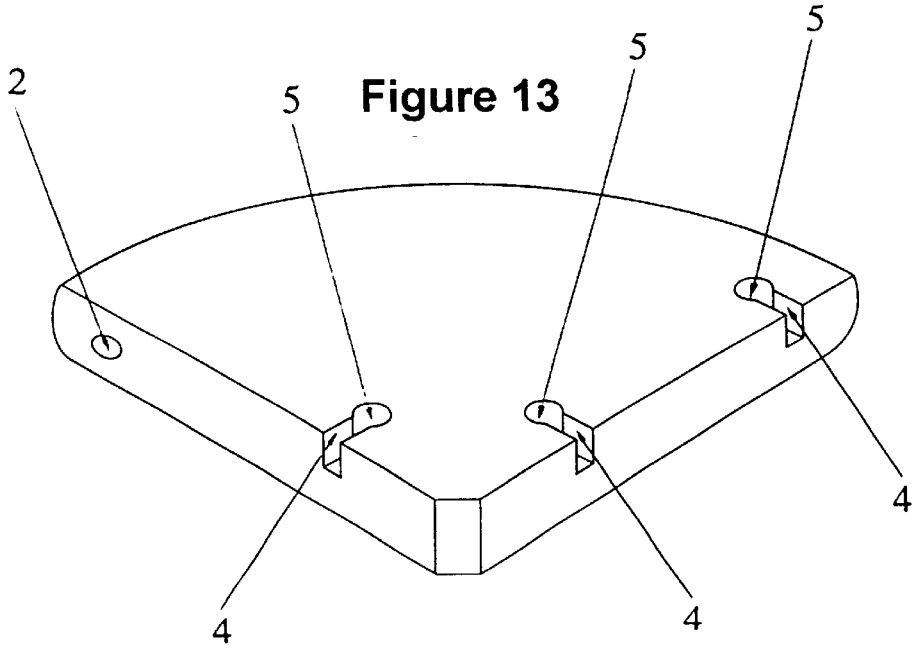

As can be deduced from the precedent description, and of the enclosed FIGS. 12 and 13, for a person skilled in this technique, the corner shelf (1) can have a plurality of perforations (2, 3) in the first lateral face (13). In the same way, the second lateral face (14) can have a plurality of channels (4) and vertical perforations (5), being able to, eventually, have this channel (4) and perforation (5) be located in the first lateral face (13) of the corner shelf (1).

From these realizations, it is possible to have a corner shelf (1) whose lateral faces (13, 14) possess only a plurality of channels (4) and vertical perforations (5). However, it is impossible to carry out an assembly process when the faces (13, 14) possess only perforations (2, 3).

Lastly, in the event that the fixation element (8) is a pin without head, the perforation (5) which does not extend through the surface perpendicular to the lower surface (12) will not be necessary, only the groove (4) is required.

The invention has been described with particular emphasis on the preferred embodiments, but variations and modifications within the spirit and scope of the invention may occur to those skilled in the art to which the invention pertains.

What is claimed is:

1. A corner shelf intended to be mounted in an angle formed by a first wall and a second wall, said shelf comprising an upper surface, a lower surface, a first lateral face and a second lateral face, wherein:

said first lateral face possesses at least one closed hole which is parallel to the upper and lower surfaces;

said second lateral face possesses at least one groove which is parallel to the lower surface, said groove extending through said lower surface and in a transverse closed bore perpendicular to the lower surface and not extending through the upper surface.

2. A corner shelf according to claim 1, wherein said first lateral face also possesses at least one groove parallel to the lower surface, said groove terminating in a transverse closed bore perpendicular to the lower surface and not extending through the upper surface.

3. A corner shelf according to claim 1, wherein said closed hole receives at least one first fixation element.

4. A corner shelf according to claim 1, wherein said groove receives a second fixation element.

5. A corner shelf according to claim wherein the second fixation element is a pin without head, and said groove not extending through the upper surface.

6. A corner shelf intended to be mounted in an angle formed by a first wall and a second wall, said shelf comprising an upper surface, a lower surface, a first lateral face and a second lateral face, wherein:

said first lateral face possesses at least one first groove which is parallel to the lower surface, said groove extending through said lower surface and in a transverse closed bore perpendicular to the lower surface and not extending through the upper surface; and said second lateral face possesses at least one second groove which is parallel to the lower surface, said second groove terminating in a transverse closed bore perpendicular to the lower surface and not extending through the upper surface, in such a way of having the same fixation system in both lateral faces.

7. A fixation system for supporting a corner shelf in an angle formed by a first wall and a second wall, said system comprising an upper surface, a lower surface, a first lateral face and a second lateral face, said first and second lateral faces intersect on said angle, wherein said system comprises:

at least one closed hole located in said first lateral face, said closed hole being parallel to the upper and lower surfaces;

at least one first fixation element introduced into at least one of said closed holes;

at least one groove located in said second lateral face, said groove being parallel to and extending through lower surface and terminating a transverse closed hole perpendicular to the lower surface and not extending through the upper surface; and at least one second fixation element having a head and a horizontal body, said body being introduced in said groove and said head being introduced in the transverse closed hole.

8. A fixation system according to claim 7, wherein said first fixation element is selected from the group consisting of a nail, screw, and pin.

9. A fixation system according to claim 7, wherein said second fixation element is selected from the group consisting of a nail, screw, and pin.

10. A fixation system according to claim 7, wherein said first fixation element is placed in said first wall.

11. A fixation system according to claim 7, wherein said second fixation element is placed in said second wall.

12. A method of mounting a corner shelf having an upper surface, a lower surface, a first lateral face having at least one closed hole being parallel to the upper and lower surfaces and a second lateral face having at least one groove being parallel to and extending through said lower surface and terminating a transverse closed hole perpendicular to the lower surface and not extending through the upper surface, an intersecting first wall and second wall using a fixation system comprising a first fixation element and a second fixation element having a head, comprising the steps of:

placing said second fixation element in said second wall, simultaneously lifting said corner shelf slightly in an angle a and enabling the head of the second fixation element to be introduced into said transverse closed hole, and mounting said first fixation element into said closed hole of the first lateral face.

13. The method of mounting a corner shelf according to claim 12, further comprising the steps of:

introducing said first fixation element into the closed hole, diminishing the angle $\alpha$, thereby lowering the corner shelf, and introducing the head of said second fixation element into the transverse closed hole.

* * * * *